US009285822B2

(12) United States Patent
Fukazawa et al.

(10) Patent No.: US 9,285,822 B2
(45) Date of Patent: Mar. 15, 2016

(54) SMALL-CIRCUIT-SCALE REFERENCE VOLTAGE GENERATING CIRCUIT

(71) Applicant: Renesas Electronics Corporation, Kawasaki (JP)

(72) Inventors: Mitsuya Fukazawa, Kawasaki (JP); Kenji Furusawa, Kawasaki (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 198 days.

(21) Appl. No.: 14/072,633

(22) Filed: Nov. 5, 2013

(65) Prior Publication Data

US 2014/0132241 A1 May 15, 2014

(30) Foreign Application Priority Data

Nov. 13, 2012 (JP) ..... 2012-249484

(51) Int. Cl.
*G05F 3/30* (2006.01)
*G05F 3/20* (2006.01)

(52) U.S. Cl.
CPC ... *G05F 3/30* (2013.01); *G05F 3/20* (2013.01)

(58) Field of Classification Search
CPC ..... G05F 3/20; G05F 3/30
See application file for complete search history.

(56) References Cited

U.S. PATENT DOCUMENTS 6,014,020 A 1/2000 Kuttner
6,331,846 B1 12/2001 Nakao
6,462,612 B1 10/2002 Roh et al.
7,408,402 B2 8/2008 Nishimura
7,560,979 B1 * 7/2009 Hsu et al. ..... 327/539
2006/0255856 A1 11/2006 Nishimura
2007/0252573 A1 * 11/2007 Tachibana et al. ..... 323/313
2009/0091378 A1 * 4/2009 Haridass et al. ..... 327/554
2009/0284242 A1 * 11/2009 Motz ..... 323/313
2012/0326693 A1 * 12/2012 Marten ..... 323/304
2013/0015835 A1 * 1/2013 Corradi et al. ..... 323/313
2013/0069616 A1 * 3/2013 Venkiteswaran et al. ..... 323/313
2014/0002052 A1 * 1/2014 Schaffer ..... 323/316
2014/0055166 A1 * 2/2014 Kotowski et al. ..... 327/55

FOREIGN PATENT DOCUMENTS

JP 11-161355 A 6/1999
JP 11-305735 A 11/1999
JP 2006-319921 A 11/2006

* cited by examiner

*Primary Examiner* — Fred E Finch, III

(74) *Attorney, Agent, or Firm* — McGinn IP Law Group, PLLC

(57) ABSTRACT

A BGR circuit controls a switch circuit in synchronization with a clock signal from a control signal generating circuit and an inverted signal thereof, and thereby, alternately switches between a differential input terminal receiving a voltage VIM and a differential input terminal receiving a voltage VIP. An LPF circuit includes capacitive elements, a switch connected between an input node and each capacitive element, and a switch connected between an output node and each capacitive element. The LPF circuit controls ON/OFF of the switches in synchronization with a clock signal CLK, and thereby, calculates a moving average value of an output voltage of the BGR circuit in the most recent one clock cycle.

3 Claims, 12 Drawing Sheets

V
Vos
f=0
f
APPLY CHOPPER

V
Vos (AFTER FREQUENCY MODULATION)
fclk
f

V
fc
f

V
Vos (AFTER REMOVAL)
fc
fclk
f

V
f

V
Vos (AFTER REMOVAL)
fclk
f

IDEAL STATE
V
T
Vos≠0

BEFORE TRIMMING
V
T
[2]
[1]
T0

AFTER TRIMMING
V
T
[3]
T0
REMOVE Vos

BEFORE TRIMMING
V
T
[1]
T0

AFTER TRIMMING
V
T
[3]
T0

SMALL-CIRCUIT-SCALE REFERENCE VOLTAGE GENERATING CIRCUIT

BACKGROUND OF THE INVENTION

1. Field of the Invention

The present invention relates to a reference voltage generating circuit that generates a reference voltage with low temperature dependence.

2. Description of the Background Art

In order to improve the accuracy of a semiconductor device, fluctuations of a reference voltage caused by temperature change need to be very small. A bandgap reference (BGR) circuit is widely used as a circuit that generates such a reference voltage. The BGR circuit is generally configured to generate a reference voltage with low temperature dependence by adding a voltage having a positive temperature dependence and a voltage having a negative temperature dependence at an appropriate ratio.

In the actual BGR circuit, however, two input voltages of an operational amplifier as a component do not completely match with each other due to the element variation, and there is a voltage difference (hereinafter referred to as "offset voltage") between the input voltages. Therefore, due to an influence of the offset voltage of the operational amplifier, the accuracy of the reference voltage decreases.

In order to eliminate the aforementioned influence of the offset voltage, U.S. Pat. No. 6,462,612, for example, proposes a BGR circuit having a chopper circuit incorporated thereinto. This BGR circuit converts an offset voltage component of an operational amplifier into an alternating current component by using the chopper circuit. Then, the BGR circuit removes this alternating current component by using a low pass filter (LPF) circuit, thereby generating an ideal reference voltage that does not include the offset voltage component.

In the technique described in the aforementioned document, an RC filter formed of a combination of a resistive element and a capacitive element is applied as the LPF circuit. The frequency characteristic of the RC filter is determined by selection of a resistance value of the resistive element and a capacitance value of the capacitive element.

On the other hand, the BGR circuit is a circuit that is widely used as a reference voltage source of the semiconductor device, and thus, low current consumption and small occupied area are required. In order to achieve low current consumption, the settling time of the operational amplifier cannot be shortened. Therefore, the frequency (chopper frequency) of a switch signal that controls the chopper circuit cannot be set high.

In order to remove the offset voltage component by using the low-frequency switch signal, the cutoff frequency of the LPF circuit needs to be set lower than the chopper frequency. However, as for the RC filter, at least one of the resistance value of the resistive element and the capacitance value of the capacitive element becomes larger as the cutoff frequency is reduced. Therefore, the area occupied by the LPF circuit becomes larger and the circuit scale of the BGR circuit increases. The other problems and novel features will become more apparent from the description of the specification and the accompanying drawings.

SUMMARY OF THE INVENTION

A reference voltage generating circuit according to one embodiment includes: a bandgap reference circuit generating a bandgap reference voltage; and a filter circuit for smoothing the bandgap reference voltage. The bandgap reference circuit includes: a reference voltage circuit that is configured to include an operational amplifier receiving a first input voltage at one differential input terminal and receiving a second input voltage at the other differential input terminal, and that generates the bandgap reference voltage based on an output voltage of the operational amplifier; and a switch circuit for alternately switching between the differential input terminal receiving the first input voltage and the differential input terminal receiving the second input voltage, in synchronization with a clock signal. The filter circuit operates in synchronization with the clock signal and calculates a moving average value of the bandgap reference voltage in a most recent one clock cycle.

According to the aforementioned embodiment, in the reference voltage generating circuit, the highly accurate reference voltage can be generated in a small circuit scale.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
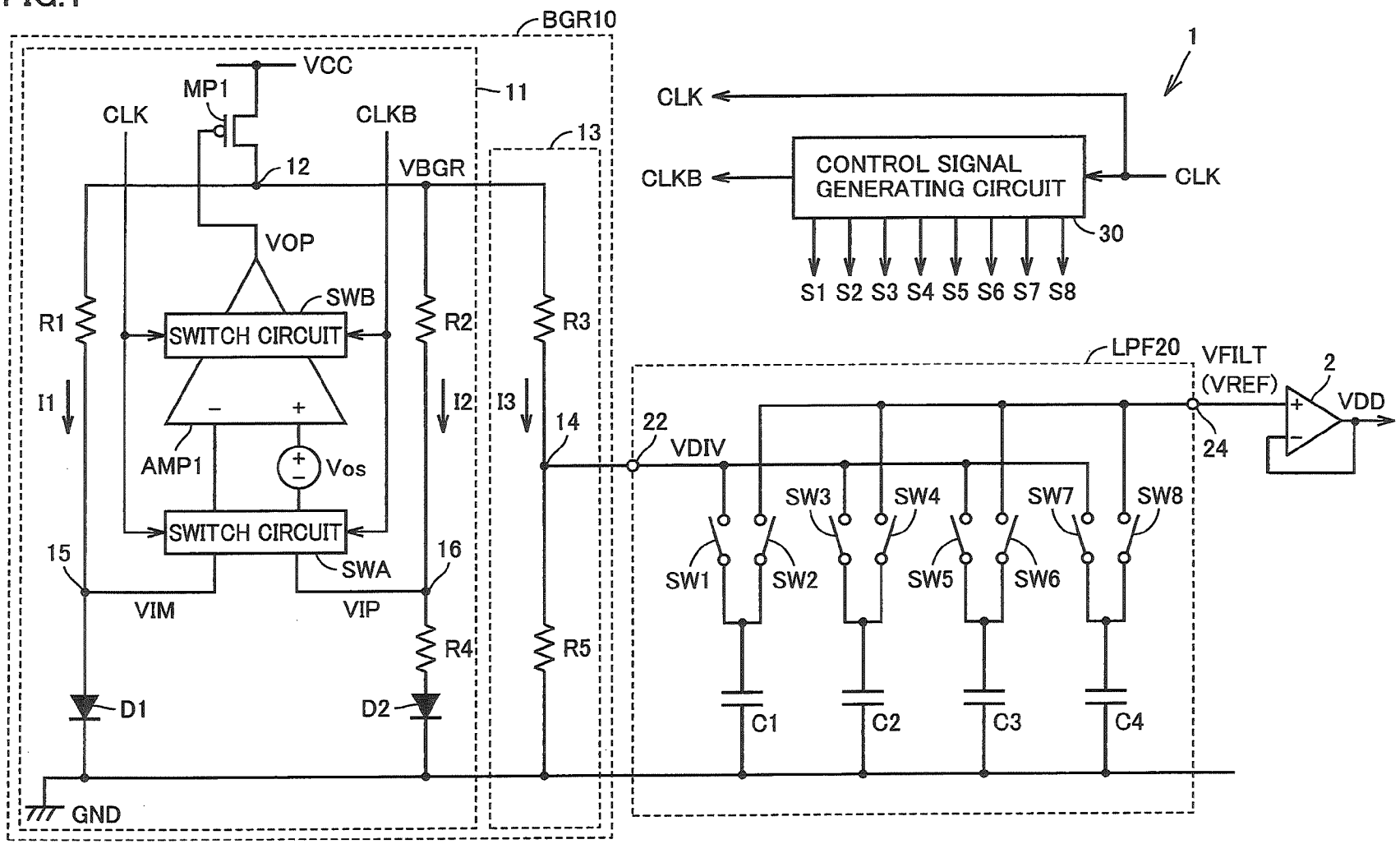
FIG. 1 is a circuit diagram showing a structure of a reference voltage generating circuit according to an embodiment.

An embodiment will be described in detail hereinafter with reference to the drawings. The same or corresponding portions are denoted by the same reference characters and description thereof will not be repeated.

[Schematic Structure of Conventional Reference Voltage Generating Circuit]

Figure 13:
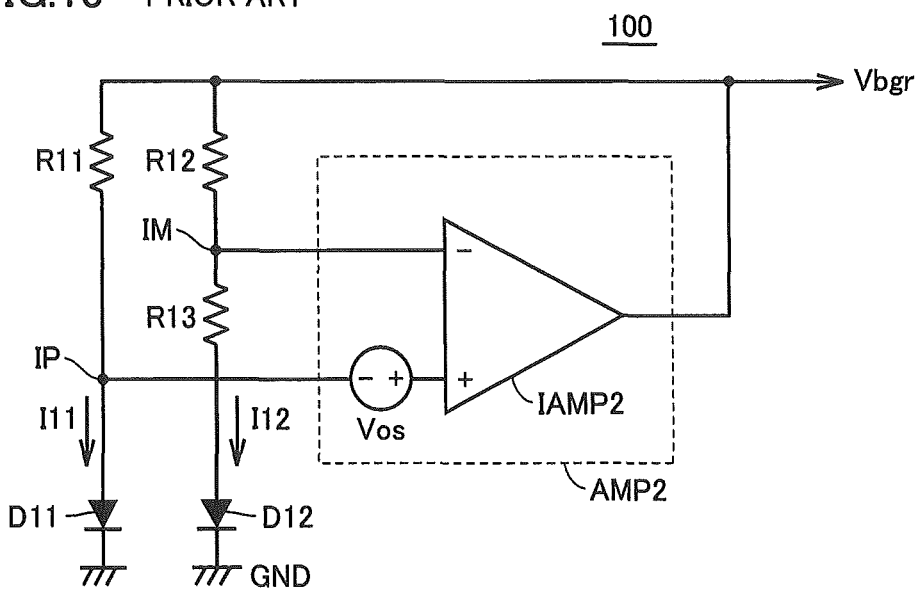
FIG.13 PRIOR ART
FIG. 13 is a circuit diagram showing a structure of a common BGR circuit.

First, a schematic structure and a problem of a conventional reference voltage generating circuit will be described with reference to the drawings. FIG. 13 is a circuit diagram showing a structure of a common BGR circuit used as the conventional reference voltage generating circuit.

Referring to FIG. 13, a BGR circuit 100 includes diodes D11 and D12, resistive elements R11 to R13, and an operational amplifier AMP2. Diodes D11 and D12 are each formed by a pnp bipolar transistor. The operation of the conventional BGR circuit will be briefly described below.

Assuming that Vbe represents a base-to-emitter voltage of the pnp bipolar transistor or a forward voltage at a pn junction, a relationship between the forward voltage at the pn junction and the absolute temperature can be expressed by the following equation (1):

$$Vbe=Veg-aT \quad (1).$$

In the equation (1) above, Veg represents a bandgap voltage of silicon, a represents a temperature dependence of Vbe, and T represents an absolute temperature.

A relationship between an emitter current IE and voltage Vbe of the pnp bipolar transistor is provided by the following equation (2):

$$IE=I0\exp(qVbe/kT) \quad (2).$$

In the equation (2) above, I0 represents a constant (proportional to the emitter area), q represents a charge of an electron, and k represents the Boltzmann constant.

Due to the negative feedback of operational amplifier AMP2, an input node IM and an input node IP of operational amplifier AMP2 are substantially equal to each other in potential when a voltage gain of operational amplifier AMP2 is sufficiently high. At this time, if resistance values of resistive elements R11 and R12 are set at, for example, 1:n (n is a positive number), the magnitude of currents I11 and I12 flowing through diodes D11 and D12 becomes n:1 and the relationship of I11=n×I12 is satisfied.

Assuming that the emitter area of diode D12 is n times as large as the emitter area of diode D11 and also assuming that Vbe1 represents a base-to-emitter voltage of diode D11 and Vbe2 represents a base-to-emitter voltage of diode D12, the following equations (3) and (4) are obtained from the equation (2) above:

$$n\times I12=I0\exp(qVbe1/kT) \quad (3)$$

$$I12=n\times I0\exp(qVbe2/kT) \quad (4).$$

I12 is eliminated from the equations (3) and (4) above and Vbe1−Vbe2 is expressed as ΔVbe. Then, the following equation (5) is obtained:

$$\Delta Vbe=(kT/q)1n(n^2) \quad (5).$$

Based on the equation (5) above, difference ΔVbe in base-to-emitter voltage between diode D11 and diode D12 is provided by a logarithm ($1n(n^2)$) of a current density ratio between diodes D11 and D12 and a thermal voltage (kT/q).

Since ΔVbe is a potential difference across resistive element R13, a current of ΔVbe/R13 flows through resistive elements R12 and R13. Therefore, a potential difference VR12 across resistive element R12 is expressed by the following equation (6):

$$VR12=\Delta Vbe\times R12/R13 \quad (6).$$

As described above, the potential of input IM is equal to potential Vbe1 of input IP, and thus, a reference voltage Vbgr is expressed by the following equation (7):

$$Vbgr=Vbe1+\Delta Vbe\times R12/R13 \quad (7).$$

As shown in the equation (1) above, forward voltage Vbe at the pn junction has a negative temperature dependence that forward voltage Vbe decreases as the temperature increases. On the other hand, as shown in the equation (5) above, ΔVbe increases in proportion to the temperature. Therefore, by appropriately selecting the constant and canceling out an amount of change in Vbe1 with ΔVbe×R12/R13, a value of reference voltage Vbgr can be designed so as not to be temperature-dependent.

As described above, in conventional BGR circuit 100, the reference voltage with low temperature dependence can be generated in a relatively simple circuit, by appropriately selecting the circuit constant. On the other hand, when BGR circuit 100 is formed by a CMOS circuit, a voltage difference (offset voltage) occurs between the two input voltages of operational amplifier AMP2 due to the element variation caused by fluctuations in the manufacturing process and the like. In operational amplifier AMP2 in FIG. 13, IAMP2 represents an ideal operational amplifier, and Vos represents an offset voltage. Due to this offset voltage Vos of operational amplifier AMP2, a potential difference across resistive element R13 in BGR circuit 100 is ΔVbe+Vos, and thus, reference voltage Vbgr has a value expressed by the following equation (8):

$$Vbgr=Vbe1+Vos+(\Delta Vbe+Vos)\times R12/R13 \quad (8).$$

As shown in the equation (8) above, conventional BGR circuit 100 has a problem that the accuracy of reference voltage Vbgr decreases due to the influence of offset voltage Vos of operational amplifier AMP2. In order to reduce the aforementioned influence of offset voltage Vos, there has been proposed in recent years a BGR circuit having incorporated thereinto a so-called chopper circuit for switching the internal operation to cancel out offset voltage Vos as described in the aforementioned document, for example. This BGR circuit is also referred to as "chopper stabilized bandgap reference circuit".

Figure 14:
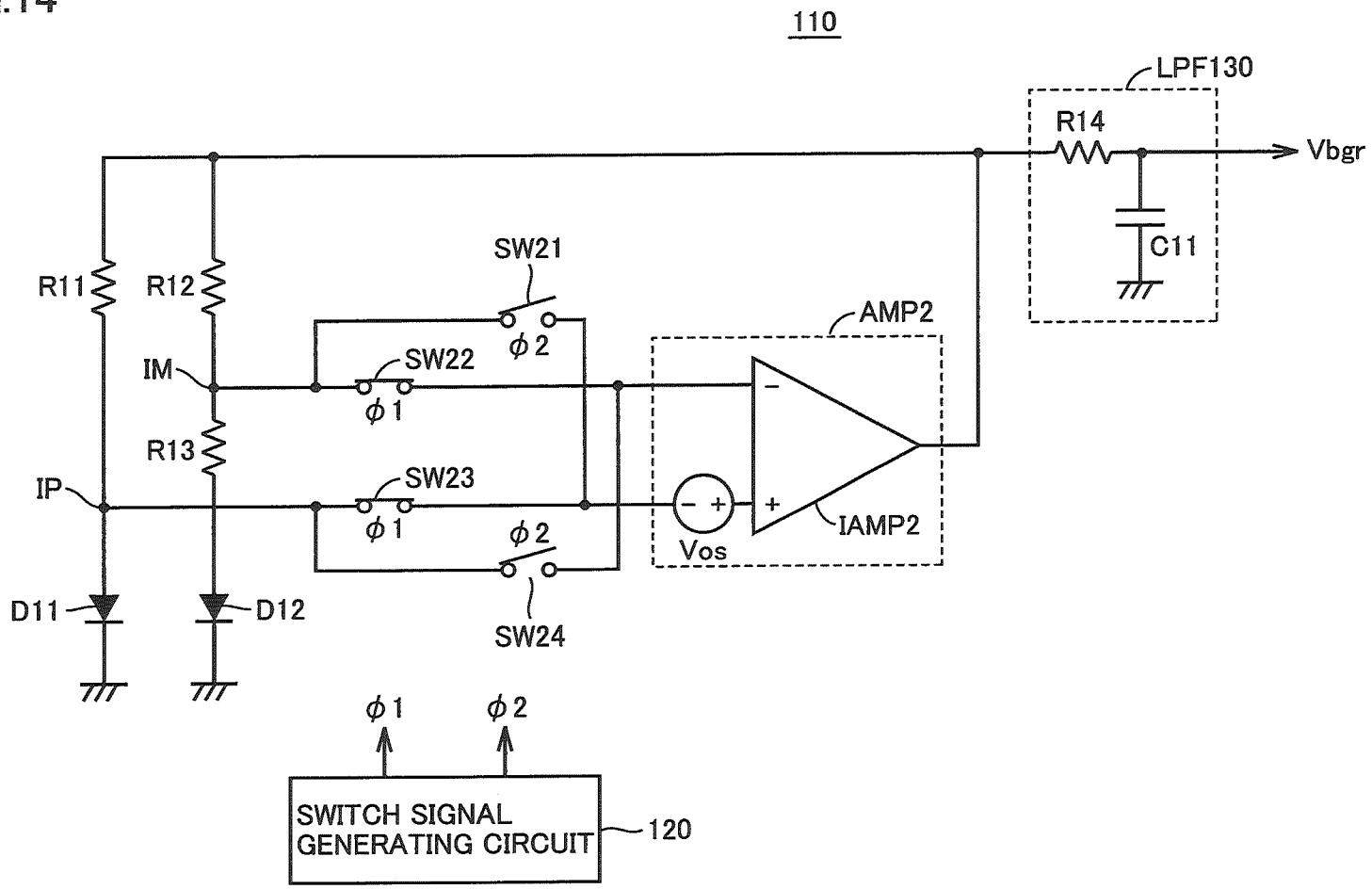
FIG. 14 is a circuit diagram showing one example of a structure of a conventional chopper stabilized BGR circuit.

FIG. 14 is a circuit diagram showing one example of a structure of the conventional chopper stabilized BGR circuit.

Referring to FIG. 14, a chopper stabilized BGR circuit 110 is different from BGR circuit 100 shown in FIG. 13 in that switches SW21 to SW24, a switch signal generating circuit 120 and an LPF circuit 130 are further provided. The same components as those described, with reference to FIG. 13 are denoted by the same reference characters and detailed description will not be repeated.

Switch SW21 is connected between input node IM and a non-inverting input terminal (+ terminal) of ideal operational amplifier IAMP2. Switch SW22 is connected between input node IM and an inverting input terminal (− terminal) of ideal operational amplifier IAMP2. Switch SW23 is connected between input node IP and the non-inverting input terminal. Switch SW24 is connected between input node IP and the inverting input terminal. ON/OFF of switches SW22 and SW23 is controlled in accordance with a switch signal ϕ1 provided from switch signal generating circuit 120. ON/OFF of switches SW21 and SW24 is controlled in accordance with a switch signal ϕ2 provided from switch signal generating circuit 120. Switch signal generating circuit 120 generates switch signals ϕ1 and ϕ2 such that switches SW22, SW23 and switches SW21, SW24 are turned on and off in a complementary manner.

During a period in which switch signal ϕ1 is in the H (logic high) level, switches SW22 and SW23 are ON (in the conduction state) and switches SW21 and SW24 are OFF (in the non-conduction state) as shown in FIG. 14. In this case, chopper stabilized BGR circuit 110 operates similarly to BGR circuit 100 shown in FIG. 13. At this time, offset voltage Vos of operational amplifier AMP2 is added to an ideal reference voltage (ideal value) and outputted from operational amplifier AMP2. Assuming, for example, that Vbgr represents an ideal value, an output voltage of operational amplifier AMP2 is Vbgr+Vos.

On the other hand, during a period in which switch signal ϕ2 is in the H level, switches SW21 and SW24 are ON and switches SW22 and SW23 are OFF. As a result, connection between input nodes IM, IP and the differential input terminals (+ terminal and − terminal) of ideal amplifier IAMP2 is switched. An output voltage of operational amplifier AMP2 at this time is Vbgr−Vos.

As described above, the output voltage of operational amplifier AMP2 is alternately switched between Vbgr+Vos and Vbgr−Vos in synchronization with switch signals ϕ1 and ϕ2. In other words, offset voltage Vos that occurs at the output voltage during the period in which switch signal ϕ1 is in the H level and offset voltage Vos that occurs at the output voltage during the period in which switch signal ϕ2 is in the H level are opposite to each other in polarity and are equal to each other in absolute value. Therefore, the output voltage is equal to ideal value Vbgr on average.

Then, this output voltage of operational amplifier AMP2 is inputted to LPF circuit 130 formed by a resistive element R14 and a capacitive element C11, and a direct current component thereof is taken out. The reference voltage that does not include the offset voltage component can thus be outputted. As described above, in conventional chopper stabilized BGR circuit 110, the offset voltage component is converted into an alternating current component by frequency modulation using switch signals ϕ1 and ϕ2. Then, the frequency-modulated offset voltage component is removed by LPF circuit 130. Ideal reference voltage Vbgr is thus obtained.

The BGR circuit is a circuit that is widely used as a reference voltage source of the semiconductor device, and thus, low current consumption and small occupied area are required. In order to achieve low current consumption, the settling time of the incorporated operational amplifier cannot be shortened. Therefore, the frequency (hereinafter also referred to as "chopper frequency") of switch signals ϕ1 and ϕ2 that control the chopper operation of the chopper stabilized BGR circuit cannot be set high.

In order to remove the offset voltage component by using low-frequency switch signals ϕ1 and ϕ2, the cutoff frequency of the LPF circuit needs to be set lower than the chopper frequency. When the LPF circuit is formed by the RC filter including a combination of resistive element R14 and capacitive element C11 as shown in FIG. 14, a resistance value of resistive element R14 and a capacitance value of capacitive element C11 become larger as the cutoff frequency is reduced. As a result, the area occupied by the LPF circuit becomes larger and the circuit scale of the BGR circuit increases.

Thus, in one embodiment, the chopper stabilized BGR circuit is formed by using an LPF circuit in which filter properties are not dependent on a value of a passive element, as described below. As a result, a small-circuit-scale reference voltage generating circuit is implemented.

[Structure of Reference Voltage Generating Circuit According to First Embodiment]

FIG. 1 is a circuit diagram showing a structure of a reference voltage generating circuit according to a first embodiment. A reference voltage generating circuit 1 according to the present embodiment steps down an external power supply voltage VCC supplied from outside a semiconductor device, and generates a reference voltage VREF. Reference voltage VREF is controlled to have a fixed value by a BGR circuit 10 regardless of temperature change.

A buffer circuit 2 operates by external power supply voltage VCC and generates an internal power supply voltage VDD that is equal in magnitude to reference voltage VREF generated by reference voltage generating circuit 1. By way of example, buffer circuit 2 is formed by a voltage follower circuit. Buffer circuit 2 supplies generated internal power supply voltage VDD to an internal circuit (not shown). Buffer circuit 2 is provided to increase an amount of current supplied to the internal circuit. When the semiconductor device is a microcomputer, the internal circuit includes a CPU (Central Processing Unit), an RAM (Random Access Memory), a peripheral LSI (Large Scale Integration) and the like. Internal power supply voltage VDD is used as a driving voltage of the internal circuit.

Referring to FIG. 1, reference voltage generating circuit 1 according to the present embodiment includes BGR circuit 10, an LPF circuit 20 and a control signal generating circuit 30.

BGR circuit 10 includes a reference voltage circuit 11 that receives external power supply voltage VCC and generates bandgap reference voltage VBGR, and a voltage dividing circuit 13 that divides generated bandgap reference voltage VBGR and thereby generates a divided voltage VDIV. The aforementioned chopper stabilized BGR circuit is applied as BGR circuit 10 in order to reduce the influence of offset voltage Vos of an operational amplifier AMP1 incorporated therein.

LPF circuit 20 operates in accordance with control signals S1 to S8 provided from control signal generating circuit 30 and thereby removes the offset voltage component of operational amplifier AMP1 from divided voltage VDIV. An output voltage VFILT of LPF circuit 20 is supplied as reference voltage VREF to buffer circuit 2.

One example of a structure of each of BGR circuit 10, LPF circuit 20 and control signal generating circuit 30 will be described below.

(Structure of BGR Circuit)

BGR circuit 10 includes a PMOS (Positive-channel Metal Oxide Semiconductor) transistor MP1, operational amplifier AMP1, resistive elements R1 to R5, diodes D1 and D2, and switch circuits SWA and SWB. Diodes D1 and D2 are each formed by a pnp bipolar transistor. PMOS transistor MP1, operational amplifier AMP1, switch circuits SWA and SWB, resistive elements R1, R2 and R4, and diodes D1 and D2 form reference voltage circuit 11. Resistive elements R3 and R5 form voltage dividing circuit 13.

PMOS transistor MP1 is connected between a power supply node VCC that receives external power supply voltage VCC and an output node 12 that outputs a bandgap reference voltage VBGR to voltage dividing circuit 13. A gate of PMOS transistor MP1 is connected to an output terminal of operational amplifier AMP1.

Resistive element R1 and diode D1 are serially connected in this order between output node 12 and a ground node GND. Resistive elements R2 and R4 and diode D2 are serially connected in this order between output node 12 and ground node GND. Diode D1 has an anode connected to resistive element R1 and a cathode connected to ground node GND. A connection node (input node 15) connecting resistive element R1 and diode D1 is connected to an inverting input terminal (– terminal) of operational amplifier AMP1, Diode D2 has an anode connected to resistive element R4 and a cathode connected to ground node GND. A connection node (input node 16) connecting resistive elements R2 and R4 is connected to a non-inverting input terminal (+ terminal) of operational amplifier AMP1.

Figure 3:
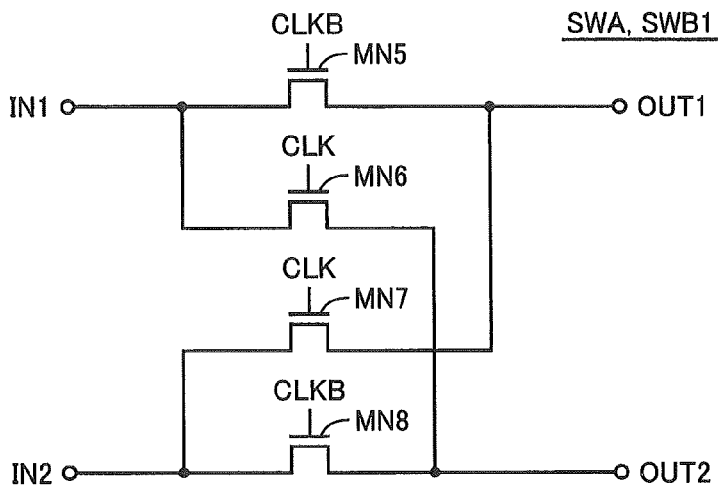
FIG. 3 is a circuit diagram showing one example of a structure of switch circuits SWA and SWB1 in FIG. 2.

Switch circuit SWA is provided between the differential input terminals (– terminal and + terminal) of operational amplifier AMP1 and input nodes 15, 16. Switch circuit SWB is provided between the differential input terminals (+ terminal and – terminal) and the output terminal of operational amplifier AMP1. Switch circuits SWB1 and SWB2 shown in FIG. 3 are collectively referred to as switch circuit SWB. The operation of turning on and off switch circuits SWA and SWB is controlled in synchronization with clock signals CLK and CLKB. Clock signals CLK and CLKB are signals complementary to each other. By way of example, clock signal CLKB is generated by inverting clock signal CLK in control signal generating circuit 30.

Resistive elements R3 and R5 are serially connected in this order between output node 12 and ground node GND. Divided voltage VDIV obtained by dividing bandgap reference voltage VBGR is outputted from a connection node (voltage dividing node) 14 connecting resistive elements R3 and R5. Assuming that $\alpha$ represents a voltage division ratio of voltage dividing circuit 13, divided voltage VDIV is equal to a value obtained by multiplying bandgap reference voltage VBGR by voltage division ratio $\alpha$.

Figure 2:
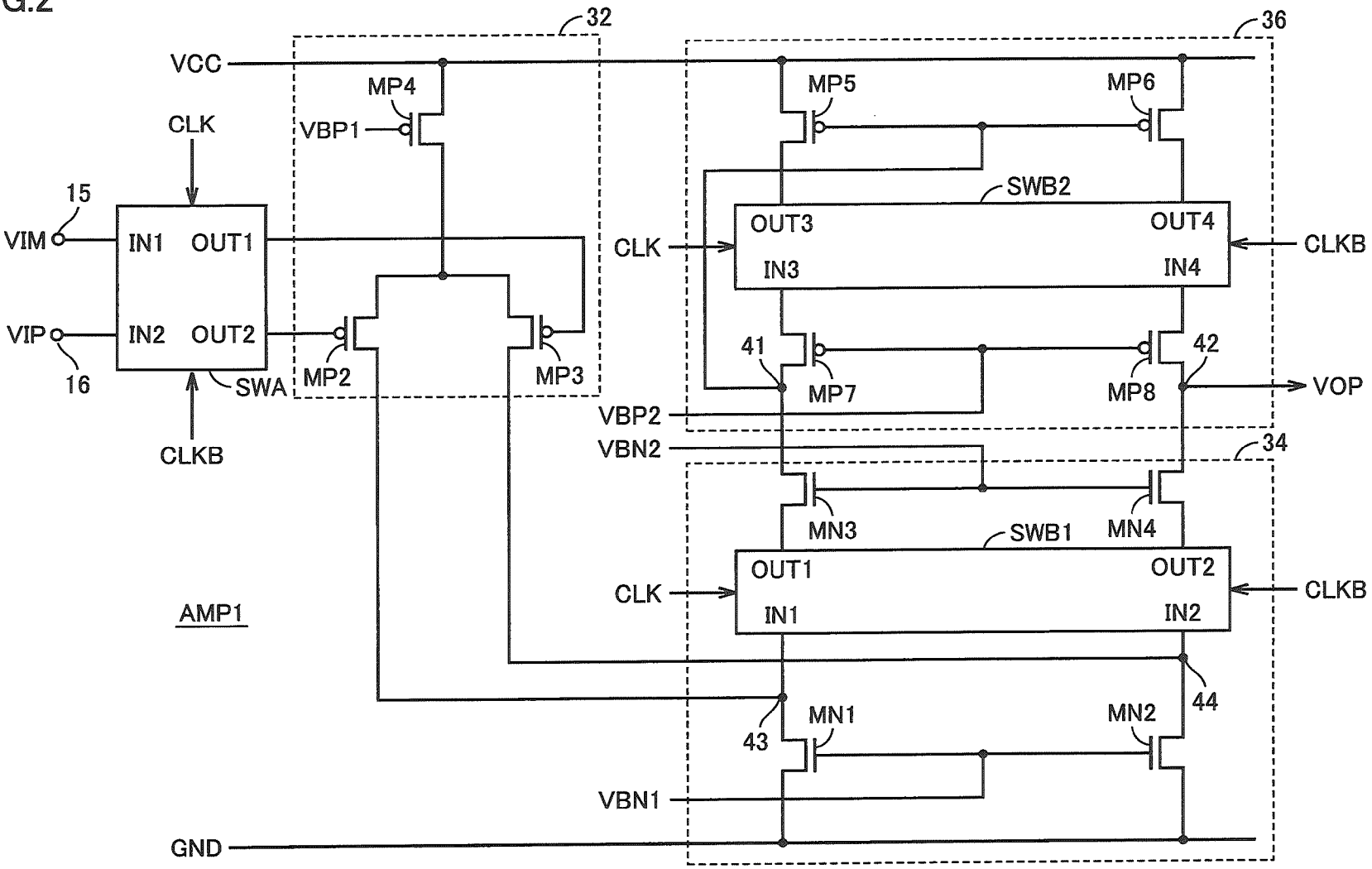
FIG. 2 is a circuit diagram showing one example of a structure of an operational amplifier in FIG. 1.

FIG. 2 is a circuit diagram showing one example of a structure of operational amplifier AMP1 in FIG. 1.

Referring to FIG. 2, operational amplifier AMP1 is formed by a folded cascode-type operational amplifier, by way of example. Specifically, operational amplifier AMP1 includes a differential input unit 32 formed by PMOS transistors MP2, MP3 and MP4, a folded cascode-type current mirror unit 34 formed by NMOS transistors MN1 to MN4, and a folded cascode-type current mirror unit 36 formed by PMOS transistors MP5 to MP8.

In differential input unit 32, PMOS transistor MP2 has a source connected to a drain of PMOS transistor MP4 and a drain connected to a connection node (node 43) connecting NMOS (Negative-channel Metal Oxide Semiconductor) transistors MN3 and MN1. PMOS transistor MP3 has a source connected to the drain of PMOS transistor MP4 and a drain connected to a connection node (node 44) connecting NMOS transistors MN4 and MN2. A gate of PMOS transistor MP2 corresponds to the non-inverting input terminal (+ terminal) of operational amplifier AMP1, and a gate of PMOS transistor MP3 corresponds to the inverting input terminal (– terminal) of operational amplifier AMP1.

In folded cascode-type current mirror unit 34, a bias voltage VBN1 is applied to a gate junction of NMOS transistors MN1 and MN2. A bias voltage VBN2 is applied to a gate junction of NMOS transistors MN3 and MN4.

In folded cascode-type current mirror unit 36, a bias voltage VBP2 is applied to a gate junction of PMOS transistors MP7 and MP8. A gate junction of PMOS transistors MP5 and MP6 is connected to a drain (node 41) of PMOS transistor MP7. A drain (node 42) of PMOS transistor MP8 corresponds to the output terminal of operational amplifier AMP1. In other words, the drain of PMOS transistor MP8 is connected to the gate of PMOS transistor MP1 (FIG. 1).

Switch circuit SWA is connected between input nodes 15, 16 and the gate (non-inverting input terminal) of PMOS transistor MP2 and the gate (inverting input terminal) of PMOS transistor MP3. In synchronization with clock signals CLK and CLKB from control signal generating circuit 30, switch circuit SWA switches between the state in which input node 15 is connected to the gate of PMOS transistor MP3 and input node 16 is connected to the gate of PMOS transistor MP2 and the state in which input node 15 is connected to the gate of PMOS transistor MP2 and input node 16 is connected to the gate of PMOS transistor MP3.

Switch circuit SWB1 is connected between NMOS transistors MN1, MN2 and NMOS transistors MN3, MN4. In synchronization with clock signals CLK and CLKB from control signal generating circuit 30, switch circuit SWB1 switches between the state in which NMOS transistor MN1 is connected to NMOS transistor MN3 and NMOS transistor MN2 is connected to NMOS transistor MN4 and the state in which NMOS transistor MN1 is connected to NMOS transistor MN4 and NMOS transistor MN2 is connected to NMOS transistor MN3.

FIG. 3 is a circuit diagram showing one example of a structure of switch circuits SWA and SWB1 in FIG. 2.

Referring to FIG. 3, each of switch circuits SWA and SWB1 includes four NMOS transistors MN5 to MN8 connected between two input terminals IN1, IN2 and two output terminals OUT1, OUT2. Specifically, NMOS transistor MN5 is connected between input terminal Ni and output terminal OUT1, and NMOS transistor MN6 is connected between input terminal Ni and output terminal OUT2. NMOS transistor MN7 is connected between input terminal IN2 and output terminal OUT1, and NMOS transistor MN8 is connected between input terminal IN2 and output terminal OUT2.

During a period in which clock signal CLKB is in the H level (=a period in which clock signal CLK is in the L level), NMOS transistors MN5 and MN8 are ON and NMOS transistors MN6 and MN7 are OFF. In this case, differential input unit 32 enters the state in which input node 15 is connected to the gate of PMOS transistor MP3 and input node 16 is connected to the gate of PMOS transistor MP2. Folded cascode-type current mirror unit 34 enters the state in which NMOS transistor MN1 is connected to NMOS transistor MN3 and NMOS transistor MN2 is connected to NMOS transistor MN4.

On the other hand, during a period in which clock signal CLK is in the H level (=a period in which clock signal CLKB is in the L level), NMOS transistors MN6 and MN7 are ON and NMOS transistors MN5 and MN8 are OFF. In this case, differential input unit 32 enters the state in which input node 15 is connected to the gate of PMOS transistor MP2 and input node 16 is connected to the gate of PMOS transistor MP3. Folded cascode-type current mirror unit 34 enters the state in which NMOS transistor MN1 is connected to NMOS transistor MN4 and NMOS transistor MN2 is connected to NMOS transistor MN3.

Referring to FIG. 2 again, switch circuit SWB2 is connected between PMOS transistors MP5, MP6 and PMOS transistors MP7, MP8. In synchronization with clock signals CLK and CLKB from control signal generating circuit 30, switch circuit SWB2 switches between the state in which PMOS transistor MP5 is connected to PMOS transistor MP7 and PMOS transistor MP6 is connected to PMOS transistor MP8 and the state in which PMOS transistor MP5 is connected to PMOS transistor MP8 and PMOS transistor MP6 is connected to PMOS transistor MP7.

Figure 4:
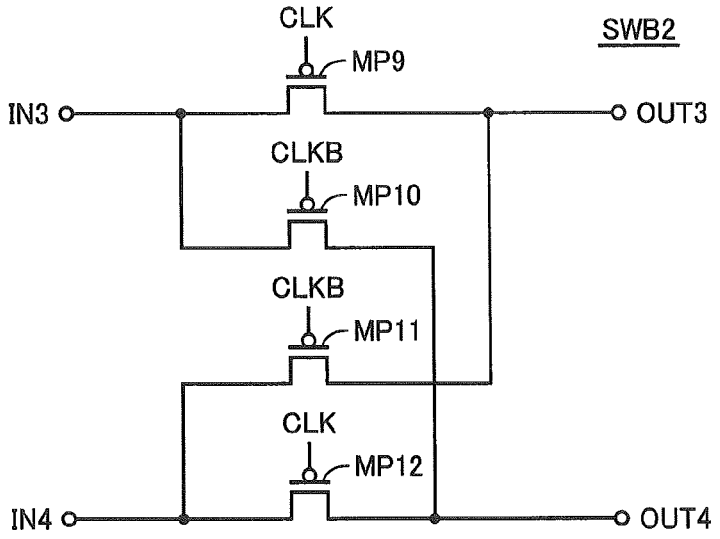
FIG. 4 is a circuit diagram showing one example of a structure of a switch circuit SWB2 in FIG. 2.

FIG. 4 is a circuit diagram showing one example of a structure of switch circuit SWB2 in FIG. 2.

Referring to FIG. 4, switch circuit SWB2 includes four PMOS transistors MP9 to MP12 connected between two input terminals IN3, IN4 and two output terminals OUT3, OUT4. PMOS transistor MP9 is connected between input terminal IN3 and output terminal OUT3, and PMOS transistor MP10 is connected between input terminal IN3 and output terminal OUT4. PMOS transistor MP11 is connected between input terminal IN4 and output terminal OUT3, and PMOS transistor MP12 is connected between input terminal IN4 and output terminal OUT4.

During a period in which clock signal CLK is in the L level (=a period in which clock signal CLKB is in the H level), PMOS transistors MP9 and MP12 are ON and PMOS transistors MP10 and MP11 are OFF. In this case, folded cascode-type current mirror unit 36 enters the state in which PMOS transistor MP5 is connected to PMOS transistor MP7 and PMOS transistor MP6 is connected to PMOS transistor MP8.

On the other hand, during a period in which clock signal CLKB is in the L level (=a period in which clock signal CLK is in the H level), PMOS transistors MP10 and MP11 are ON and PMOS transistors MP9 and MP12 are OFF. In this case, folded cascode-type current mirror unit 36 enters the state in which PMOS transistor MP5 is connected to PMOS transistor MP8 and PMOS transistor MP6 is connected to PMOS transistor MP7.

As described above, in synchronization with clock signals CLK and CLKB, switch circuits SWA, SWB1 and SWB2 switch between the state in which the two signals are transmitted in a straight manner and the state in which the two signals are transmitted in a crossed manner (in an interchanged manner). Specifically, during the period in which clock signal CLKB is in the H level, all of switch circuits SWA, SWB1 and SWB2 transmit the two signals in a straight manner. In this case, the ideal output to which offset voltage Vos is added is outputted from operational amplifier AMP1. In the following description, assuming that VBGR represents the ideal value, a bandgap reference voltage outputted from reference voltage circuit 11 during the period in which clock signal CLKB is in the H level is expressed as, for example, VBGRH=VBGR+Vos.

On the other hand, during the period in which clock signal CLK is in the H level, all of switch circuits SWA, SWB1 and SWB2 transmit the two signals in a crossed manner. In this case, the ideal output from which offset voltage Vos is subtracted is outputted from operational amplifier AMP1. In the following description, assuming that VBGR represents the ideal value, a bandgap reference voltage outputted from reference voltage circuit 11 during the period in which clock signal CLK is in the H level is expressed as, for example, VBGL=VBGR−Vos. As described above, a voltage value of bandgap reference voltage VBGR is switched to VBGRH or VBGRL in synchronization with clock signals CLK and CLKB. In other words, reference voltage circuit 11 implements the chopper stabilized BGR circuit.

Referring to FIG. 1 again, in reference voltage circuit 11, operational amplifier AMP1 controls a current flowing through PMOS transistor MP1 (i.e., currents I1 and I2 flowing through input nodes 15 and 16) such that voltages VIM and VIP of input nodes 15 and 16 become equal to each other. By appropriately selecting the resistance values of resistive elements R1, R2 and R4 and the current density ratio between diodes D1 and D2, bandgap reference voltage VBGR with low temperature dependence can be outputted from output node 12. Bandgap reference voltage VBGR includes the aforementioned offset voltage component of operational amplifier AMP1 subjected to frequency modulation by the chopper operation using clock signals CLK and CLKB.

Figure 5:
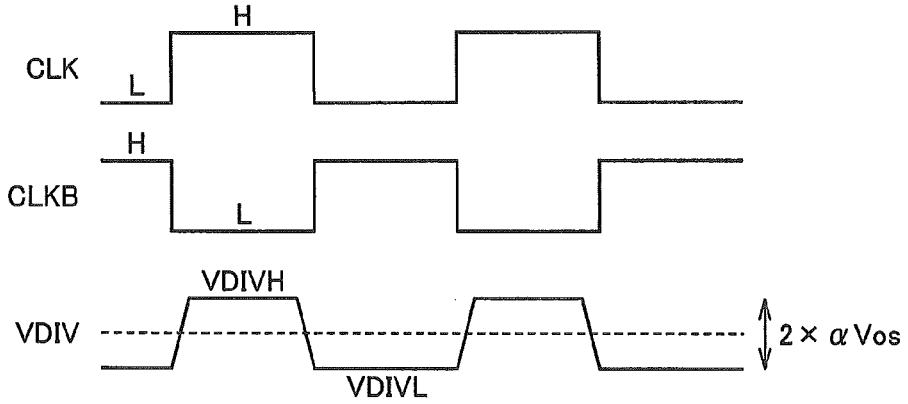
FIG. 5 is a diagram showing a relationship between a divided voltage VDIV and timings of clock signals CLK and CLKB.

Voltage dividing circuit 13 divides bandgap reference voltage VBGR at voltage division ratio α and thereby generates divided voltage VDIV. Divided voltage VDIV is outputted from a voltage dividing node 14. FIG. 5 shows a relationship between divided voltage VDIV and timings of clock signals CLK and CLKB. During the period in which clock signal CLKB is in the H level, divided voltage VDIV has a value obtained by multiplying bandgap reference voltage VBGRH (=VBGR+Vos) by voltage division ratio α of voltage dividing circuit 13. On the other hand, during the period in which clock signal CLK is in the H level, divided voltage VDIV has a value obtained by multiplying bandgap reference voltage VBGRL (=VBGR−Vos) by voltage division ratio α. In the following description, VDIVH represents a voltage value of divided voltage VDIV during the period in which clock signal CLKB is in the H level, and VDIVL represents a voltage value of divided voltage VDIV during the period in which clock signal CLK is in the H level.

(Structure and Operation of LPF Circuit)

LPF circuit 20 removes the offset voltage component of operational amplifier AMP1 from divided voltage VDIV that changes in synchronization with clock signals CLK and CLKB, and thereby smoothes divided voltage VDIV.

Specifically, referring to FIG. 1, LPF circuit 20 includes four capacitive elements C1 to C4 and eight switches SW1 to SW8. Four capacitive elements C1 to C4 are connected in parallel to one another between an input node 22 of LPF circuit 20 and ground node GND. The capacitance of capacitive elements C1 to C4 is set to be substantially equal to one another.

Switch SW1 is connected between capacitive element C1 and input node 22. Furthermore, switch SW2 is connected between capacitive element C1 and an output node 24 of LPF circuit 20. Similarly, switch SW3 is connected between capacitive element C2 and input node 22, and switch SW4 is connected between capacitive element C2 and output node 24. Switch SW5 is connected between capacitive element C3 and input node 22, and switch SW6 is connected between capacitive element C3 and output node 24. Switch SW7 is connected between capacitive element C4 and input node 22, and switch SW8 is connected between capacitive element C4 and output node 24.

Switches SW1 to SW8 are turned on and off in response to control signals S1 to S8 from control signal generating circuit 30, respectively. Specifically, when corresponding control signals S1 to S8 are in the H level, switches SW1 to SW8 are turned on (brought into conduction) and connect corresponding capacitive elements C1 to C4 and input node 22 (or output node 24). When corresponding control signals Si to S8 are in the L level, switches SW1 to SW8 are turned off (brought out of conduction) and disconnect corresponding capacitive elements C1 to C4 and input node 22 (or output node 24).

Control signal generating circuit 30 generates control signals S1 to S8 by using clock signal CLK. Control signals S1 to S8 are signals having a cycle that is a plurality of times as long as that of clock signal CLK. In the present embodiment, control signals S1 to S8 have a cycle that is twice as long as that of clock signal CLK.

The operation of LPF circuit 20 in FIG. 1 will be described below.

Figure 6:
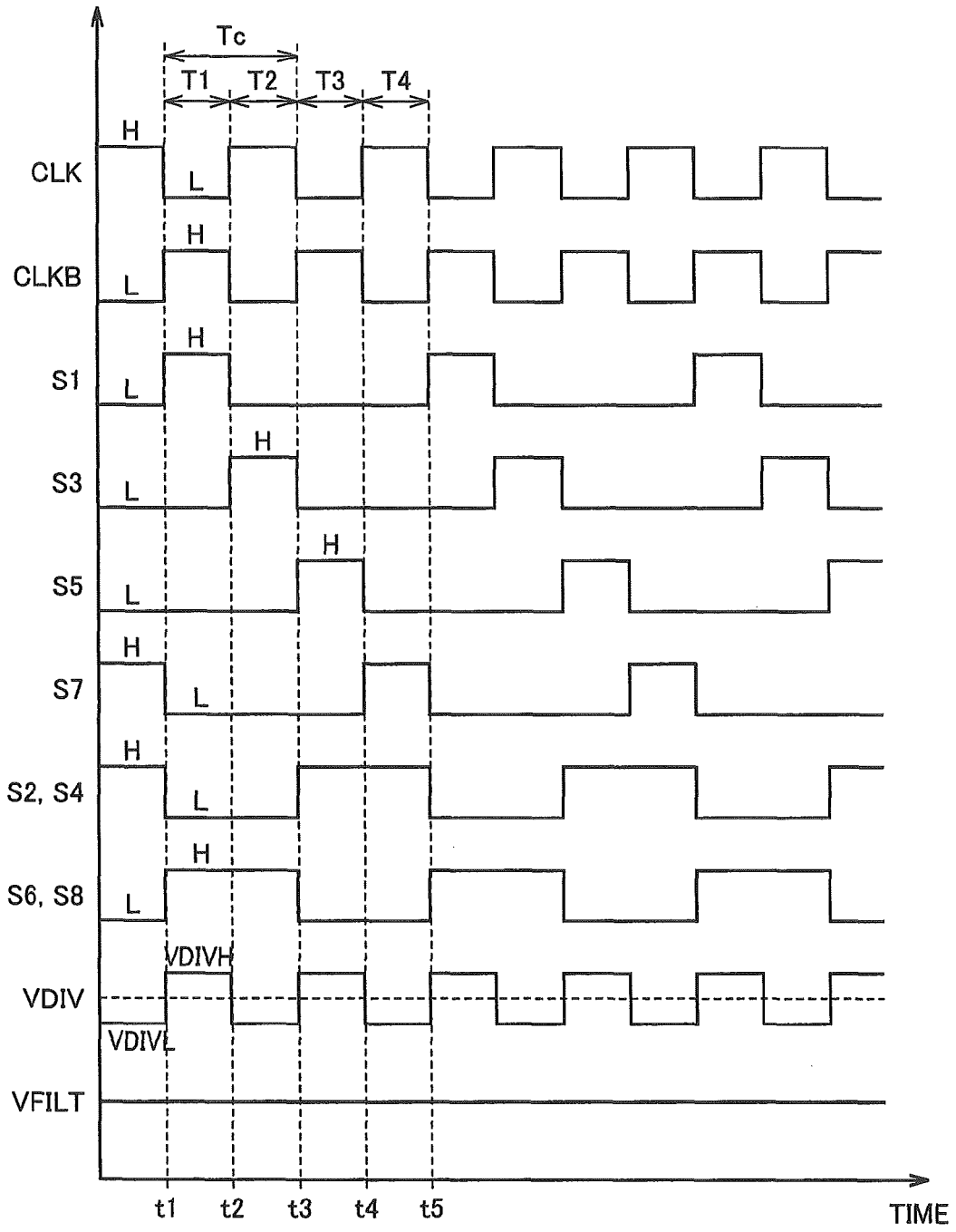
FIG. 6 is a timing chart showing the operation of an LPF circuit in FIG. 1.

FIG. 6 is a timing chart showing the operation of LPF circuit 20 in FIG. 1. FIG. 6 shows waveforms of control signals S1 to S8 supplied to switches SW1 to SW8 as well as waveforms of the input voltage (divided voltage VDIV) and output voltage VFILT (reference voltage VREF) of LPF circuit 20, in addition to waveforms of clock signals CLK and CLKB.

Referring to FIG. 6, control signals S1 to S8 have a cycle that is twice as long as a cycle Tc of clock signal CLK. Among control signals S1 to S8, control signals S1, S3, S5, and S7 are set in the H level during the 1/4 cycle (i.e., 1/2 cycle of clock signal CLK) and are set in the L level during the remaining 3/4 cycle (i.e., 3/2 cycle of clock signal CLK). The period in which the control signal is in the H level is switched in the order of control signals S1, S3, S5, and S7. In FIG. 6, assume that a period T1 represents a period in which control signal S1 is in the H level (times t1 to t2), a period T2 represents a period in which control signal S3 is in the H level (times t2 to t3), a period T3 represents a period in which control signal S5 is in the H level (times t3 to t4), and a period T4 represents a period in which control signal S7 is in the H level (times t4 to t5). After time t5, a plurality of sets of periods T1 to T4 described above are provided continuously.

Control signals S2, S4, S6, and S8 are set in the H level during the 1/2 cycle (i.e., one cycle of clock signal CLK) and are set in the L level during the remaining 1/2 cycle (i.e., one cycle of clock signal CLK). Control signals S2 and S4 and control signals S6 and S8 are complementary to each other. In FIG. 6, control signals S2 and S4 are set in the L level during periods T1 and T2, and are set in the H level during periods T3 and T4. On the other hand, control signals S6 and S8 are set in the H level during periods T1 and T2, and are set in the L level during periods T3 and T4.

In order to reliably prevent switches SW1 and SW2 from being turned on simultaneously, a non-overlap period in which switches SW1 and SW2 are OFF simultaneously is provided for control signals S1 and S2. Similarly, the non-overlap period is provided for control signals S3 and S4, control signals S5 and S6, as well as control signals S7 and S8.

As shown in FIG. 5, the value of divided voltage VDIV is switched to VDIVH or VDIVL every half cycle of clock signals CLK and CLKB. The value of divided voltage VDIV during periods T1 and T3 is VDIVH, and the value of divided voltage VDIV during periods T2 and T4 is VDIVL.

Figure 7A:
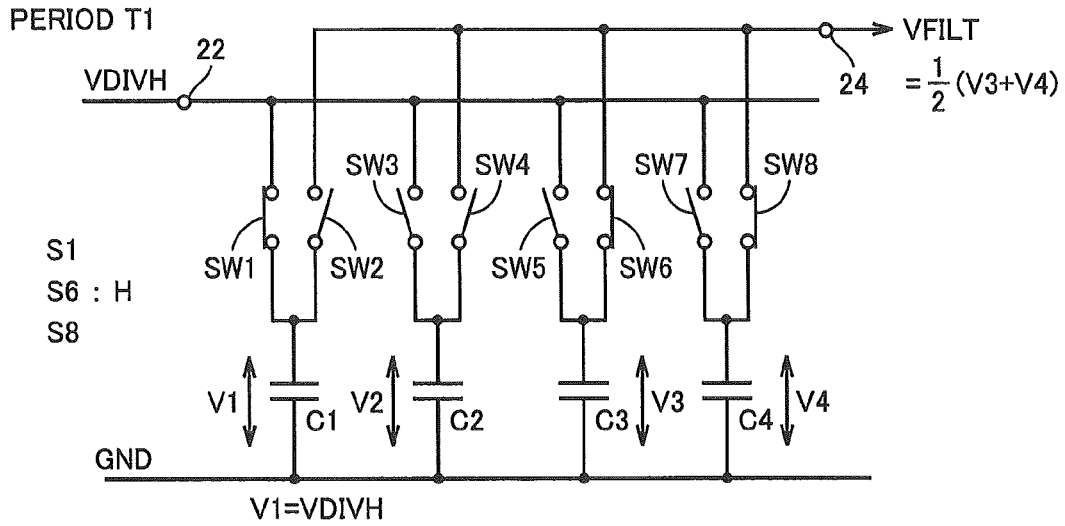
FIGS. 7A and 7B are diagrams for describing the operation of the LPF circuit during periods T1 and T2 in FIG. 6, respectively.
Figure 7B:
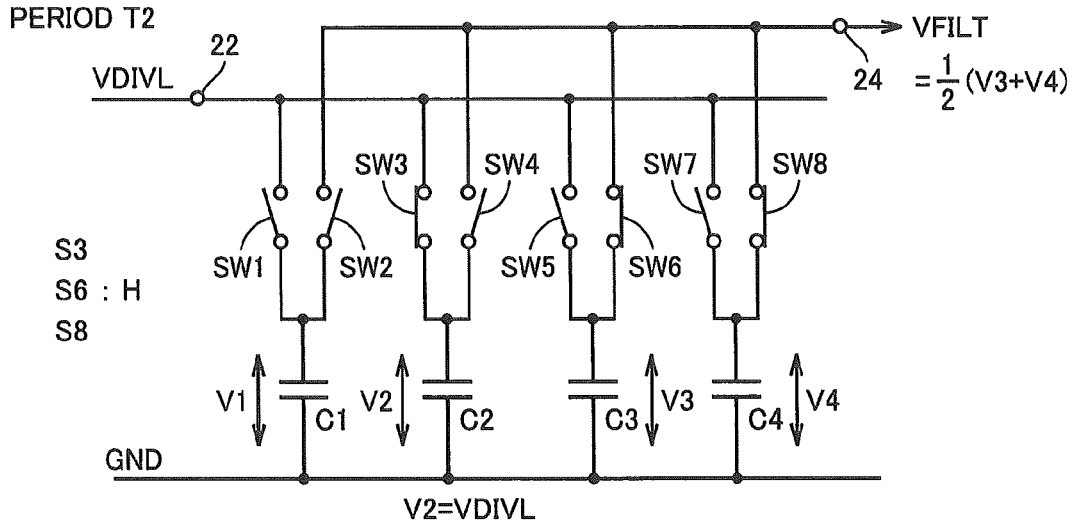

FIGS. 7A and 7B are diagrams for describing the operation of LPF circuit 20 during periods T1 and T2 in FIG. 6, respectively. FIG. 7A shows the operation of switches SW1 to SW8 during period T1, and FIG. 7B shows the operation of switches SW1 to SW8 during period T2.

Referring to FIG. 7A, at time t1, control signals 51, S6 and S8 are set in the H level. Then, switches SW1, SW6 and SW8 are turned on. When switch SW1 is turned on and capacitive element C1 is connected between input node 22 and ground node GND, divided voltage VDIV (=VDIVH) is supplied to capacitive element C1. During period T1, capacitive element C1 is charged with divided voltage VDIV. As a result, a charging voltage V1 of capacitive element C1 reaches VDIVH.

Furthermore, at time t1, switches SW6 and SW8 are turned on. Then, capacitive elements C3 and C4 are connected in parallel between output node 24 and ground node GND. As a result, in parallel with the aforementioned operation of charging capacitive element C1, reception and transmission of charges are performed between capacitive elements C3 and C4. Using a charging voltage V3 of capacitive element C3 and a charging voltage V4 of capacitive element C4, output voltage VFILT of output node 24 during period T1 is expressed by the following equation (8):

$$VFILT=\tfrac{1}{2}\cdot(V3+V4) \quad (8).$$

Referring to FIG. 7B, at time t2, control signal Si is switched to the L level and control signals S3, S6 and S8 are set in the H level. As a result, switch SW1 is turned off, and thus, charging of capacitive element C1 stops. On the other hand, switch SW3 is turned on and capacitive element C2 is connected between input node 22 and ground node GND. During period T2, capacitive element C2 is charged with divided voltage VDIV (=VDIVL). As a result, a charging voltage V2 of capacitive element C2 reaches VDIVL.

Since switches SW6 and SW8 are maintained in the ON state during period T2 as well, reception and transmission of charges are performed between capacitive elements C3 and C4 similarly to period T1 described above. Therefore, output voltage VFILT expressed by the equation (8) above is outputted from output node 24.

As described above, in LPF circuit 20, the operation of charging capacitive element C1 with divided voltage VDIVH is performed during period T1, and the operation of charging capacitive element C2 with divided voltage VDIVL is performed during period T2. Furthermore, the average voltage of charging voltage V3 of capacitive element C3 and charging voltage V4 of capacitive element C4 is outputted from output node 24 during these periods T1 and T2.

Figure 8A:
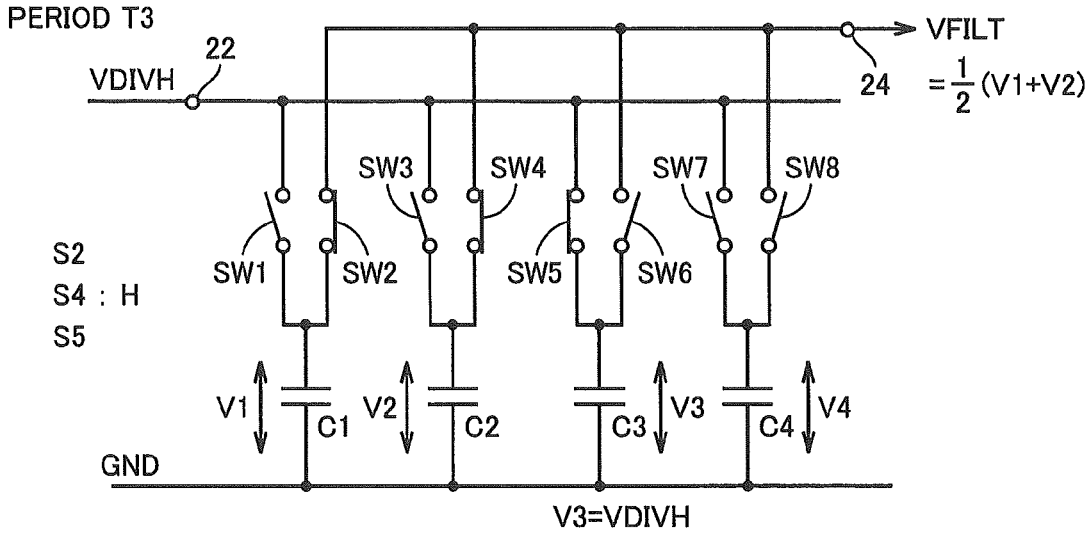
FIGS. 8A and 8B are diagrams for describing the operation of the LPF circuit during periods T3 and T4 in FIG. 6, respectively.
Figure 8B:
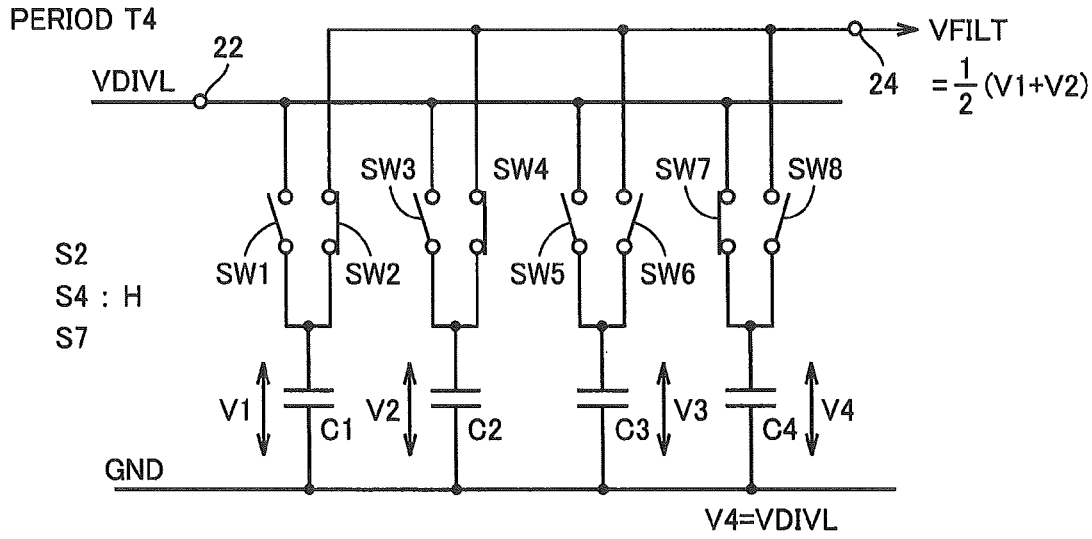

FIGS. 8A and 8B are diagrams for describing the operation of LPF circuit 20 during periods T3 and T4 in FIG. 6, respectively. FIG. 8A shows the operation of switches SW1 to SW8 during period T3, and FIG. 8B shows the operation of switches SW1 to SW8 during period T4.

Referring to FIG. 8A, at time t3, control signals S2, S4 and S5 are set in the H level. Then, switches SW2, SW4 and SW5 are turned on. When switch SW5 is turned on and capacitive element C3 is connected between input node 22 and ground node GND, divided voltage VDIV (=VDIVH) is supplied to capacitive element C3. During period T3, capacitive element C3 is charged with divided voltage VDIV. As a result, charging voltage V3 of capacitive element C3 reaches VDIVH.

Furthermore, at time t3, switches SW2 and SW4 are turned on. Then, capacitive elements C1 and C2 are connected in parallel between output node 24 and ground node GND. As a result, in parallel with the aforementioned operation of charging capacitive element C3, reception and transmission of charges are performed between capacitive elements C1 and C2. Using charging voltage V1 of capacitive element C1 and charging voltage V2 of capacitive element C2, output voltage VFILT of output node 24 during period T3 is expressed by the following equation (9):

$$VFILT=\tfrac{1}{2}\cdot(V1+V2) \quad (9).$$

Referring to FIG. 8B, at time t4, control signal S5 is switched to the L level and control signals S2, S4 and S7 are set in the H level. As a result, switch SW5 is turned off, and thus, charging of capacitive element C3 stops. On the other hand, switch SW7 is turned on and capacitive element C4 is connected between input node 22 and ground node GND. During period T4, capacitive element C4 is charged with divided voltage VDIV (=VDIVL). As a result, charging voltage V4 of capacitive element C4 reaches VDIVL.

Since switches SW2 and SW4 are maintained in the ON state during period T4 as well, reception and transmission of charges are performed between capacitive elements C1 and C2 similarly to period T3 described above. Therefore, output voltage VFILT expressed by the equation (9) above is outputted from output node 24.

As described above, in LPF circuit 20, the operation of charging capacitive element C3 with divided voltage VDIVH is performed during period T3, and the operation of charging capacitive element C4 with divided voltage VDIVL is performed during period T4. Furthermore, the average voltage of charging voltage V1 of capacitive element C1 and charging voltage V2 of capacitive element C2 is outputted from output node 24 during these periods T3 and T4.

Due to the operation of charging capacitive elements C1 and C2 during periods T1 and T2 described above, charging voltage V1 of capacitive element C1 corresponds to VDIVH and charging voltage V2 of capacitive element C2 corresponds to VDIVL. Therefore, output voltage VFILT can be rewritten like the following equation (10):

$$VFILT=\frac{1}{2}\cdot(VDIVH+VDIVL) \quad (10).$$

In other words, output voltage VFILT corresponds to an average value (moving average value) of divided voltage VDIV in the most recent one clock cycle (periods T1 and T2). Due to the operation of charging capacitive elements C3 and C4 during periods T3 and T4, charging voltage C3 of capacitive element C3 corresponds to VDIVH, and charging voltage V4 of capacitive element C4 corresponds to VDIVL. Therefore, output voltage VFILT in the immediately following one clock cycle (periods T1 and T2) can also be rewritten like the equation (10) above.

As described above, LPF circuit 20 keeps (samples) divided voltage VDIV in one clock cycle every 1/2 clock cycle and calculates an average value of two kept divided voltages VDIV in the immediately following one clock cycle. In other words, LPF circuit 20 forms a moving average filter that calculates a moving average value of divided voltage VDIV in the most recent one clock cycle. As a result, as shown in FIG. 6, output voltage VFILT of LPF circuit 20 is smoothed to an average value of VDIVH and VDIVL, and the offset voltage component of operational amplifier AMP1 is removed.

In reference voltage generating circuit 1 in FIG. 1, LPF circuit 20 is configured by a first pair of capacitive elements that are formed of two capacitive elements C1 and C2 (or C3 and C4) charged with divided voltage VDIV (VDIVH, VDIVL) in one clock cycle, and a second pair of capacitive elements that are formed of two capacitive elements C3 and C4 (or C1 and C2) outputting a moving average value of divided voltage VDIV in the most recent one clock cycle, and moving averaging is performed in accordance with an interleave method by using these two pairs of capacitive elements. As a result, output of output voltage VFILT to output node 24 can be continued. As long as two or more pairs of capacitive elements form LPF circuit 20, the interleave method can be implemented.

The number of capacitive elements that form each pair of capacitive elements may be a multiple of 2. By increasing the number of capacitive elements that form each pair of capacitive elements, an influence of capacitance variations between the plurality of capacitive elements on the moving average value can be reduced. On the other hand, the capacitance of the entire pair of capacitive elements increases, and thus, it takes time to charge the capacitive elements.

As described above, in reference voltage generating circuit 1 according to the present embodiment, the moving average filter is applied as LPF circuit 20. As a result, the area occupied by the LPF circuit can be reduced, as compared with conventional chopper stabilized BGR circuit 110 (FIG. 13) in which the RC filter is applied as the LPF circuit. The effect of reference voltage generating circuit 1 according to the present embodiment will be described below with reference to FIGS. 9A to 9F.

Figures 9A, 9B, 9C, 9D, 9E, 9F:
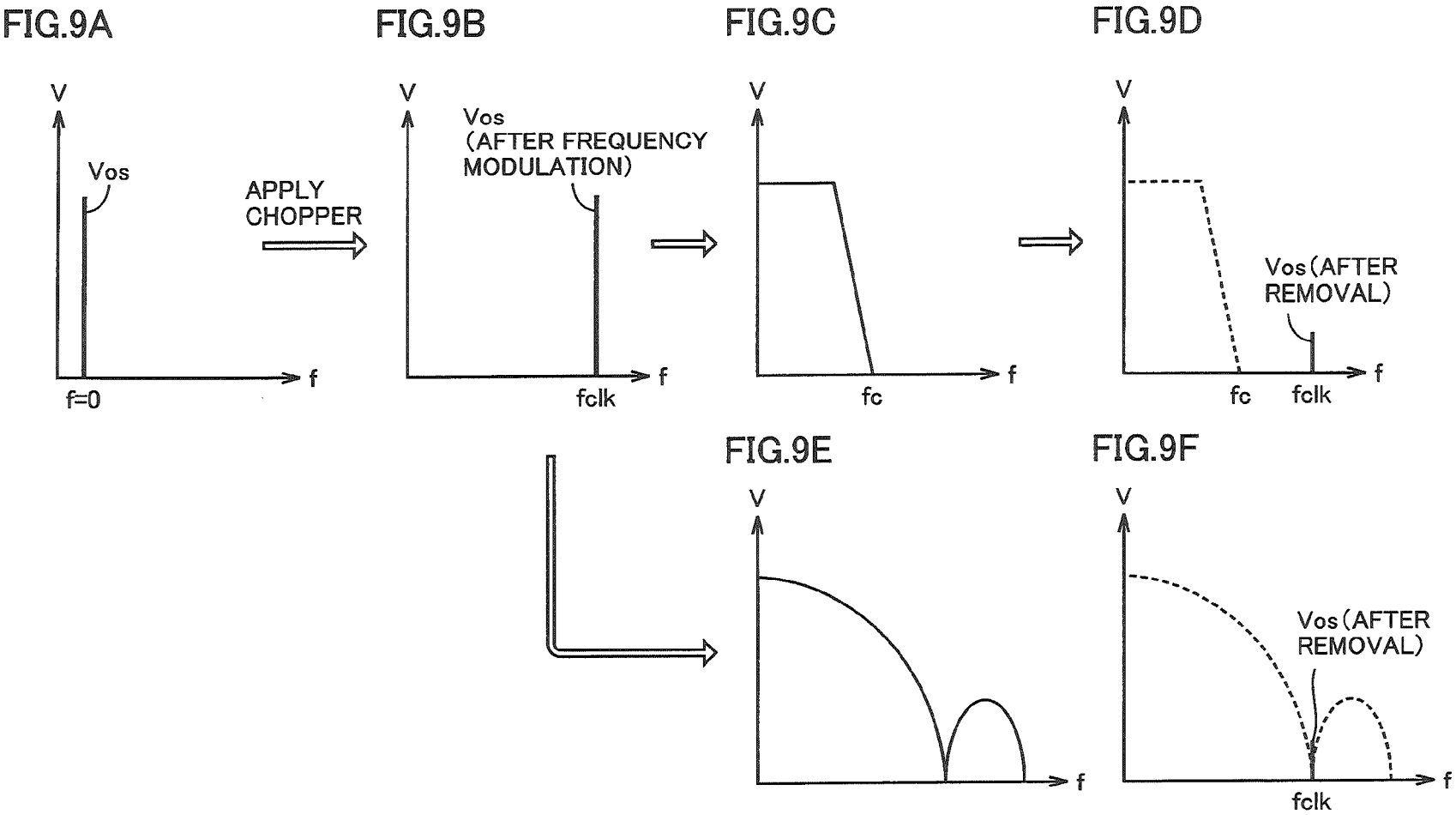
FIGS. 9A to 9F are diagrams for describing the effect of the reference voltage generating circuit according to the embodiment.

FIG. 9A shows the offset voltage component of operational amplifier AMP1 included in output voltage VDIV of BGR circuit 10. The offset voltage component of operational amplifier AMP1 is subjected to frequency modulation by the chopper operation based on clock signals CLK and CLKB. As a result, the offset voltage component is converted into an alternating current component of a frequency (chopper frequency) fclk of clock signal CLK (refer to FIG. 9B).

FIG. 9C shows the frequency characteristic when the RC filter (FIG. 13) is applied as the LPF circuit. As described above, a cutoff frequency fc of the RC filter becomes lower as the resistance values of the resistive elements and the capacitance values of the capacitors become larger. As shown in FIG. 9D, by setting the resistance values and the capacitance values such that cutoff frequency fc of the RC filter becomes lower than chopper frequency fclk, the offset voltage component is removed. However, if chopper frequency fclk is lowered from the viewpoint of low current consumption, the area occupied by the RC filter increases.

FIG. 9E shows the frequency characteristic when the moving average filter (FIG. 1) is applied as the LPF circuit. Generally, in the moving average filter, a notch frequency is determined by the operation frequency (sampling frequency) and the number of sampling points. In the present embodiment, as shown in FIG. 6, divided voltage VDIV is sampled every 1/2 cycle of clock signal CLK and an average value of divided voltage VDIV at these two sampling points is calculated. Therefore, the notch frequency of the moving average filter is determined by frequency (chopper frequency) fclk of clock signal CLK and is not dependent on the capacitance values of capacitive elements C1 to C4. According to this, by adjusting a ratio between chopper frequency fclk and the operation frequency of the moving average filter, the initial notch frequency of the moving average filter can be matched with chopper frequency fclk as shown in FIG. 9F, for example. As a result, the offset voltage component can be efficiently removed.

As described above, in reference voltage generating circuit 1 according to the present embodiment, control signals S1 to S8 of the moving average filter that forms LPF circuit 20 are generated by using clock signal CLK that controls the chopper operation of reference voltage circuit 11. Therefore, the notch frequency of the moving average filter can be matched with chopper frequency fclk and the offset voltage component having chopper frequency fclk can be efficiently removed. Unlike the cutoff frequency of the RC filter, the notch frequency of the moving average filter is not dependent on the resistance values and the capacitance values of the passive elements. Therefore, the area occupied by the LPF circuit never increases even if chopper frequency fclk is lowered. As a result, reference voltage generating circuit 1 can reduce the influence of offset voltage Vos of operational amplifier AMP1 and generate reference voltage VREF having a desired voltage level in a small circuit scale.

[Second Embodiment]

Figure 10:
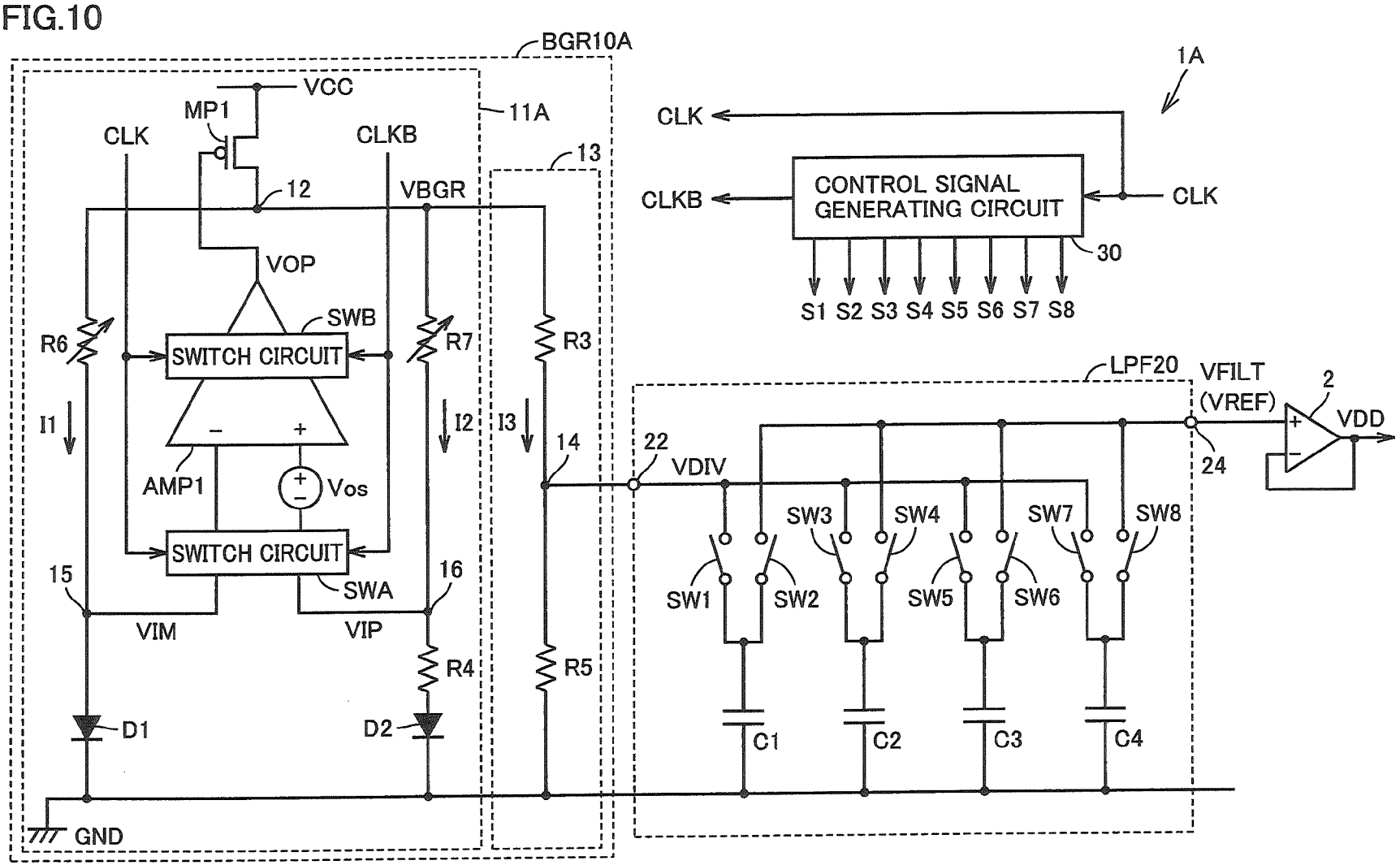
FIG. 10 is a circuit diagram showing a structure of a reference voltage generating circuit according to a second embodiment of the present invention.

FIG. 10 is a circuit diagram showing a structure of a reference voltage generating circuit according to a second embodiment of the present invention. In a reference voltage generating circuit 1A according to the second embodiment, reference voltage circuit 11 in reference voltage generating circuit 1 shown in FIG. 1 is replaced by a reference voltage circuit 11A.

Referring to FIG. 10, reference voltage circuit 11A is different from reference voltage circuit 11 shown in FIG. 1 in that resistive elements R6 and R7 are provided instead of resistive elements R1 and R2. The overall structure of reference voltage generating circuit 1A is similar to that of reference voltage generating circuit 1 shown in FIG. 1 except for resistive elements R6 and R7, and thus, detailed description will not be repeated.

Figure 11:
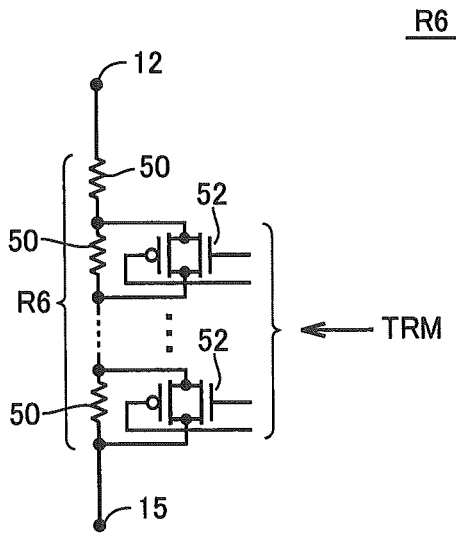
FIG. 11 is a circuit diagram showing one example of a structure of a resistive element in FIG. 10.

Resistive element R6 is connected between output node 12 and input node 15. Resistive element R7 is connected between output node 12 and input node 16. Resistive elements R6 and R7 are each formed such that a resistance value can be changed depending on a trimming code. FIG. 11 is a circuit diagram showing one example of a structure of resistive element R6.

Referring to FIG. 11, resistive element R6 includes a plurality of resistive elements 50 serially connected between output node 12 and input node 15, and a plurality of transmission gates 52. The plurality of transmission gates 52 are provided in parallel to at least a part of the plurality of resistive elements 50, respectively, and corresponding transmission gate 52 and corresponding resistive element 50 are connected in parallel. ON/OFF of each transmission gate 52 is determined by a trimming code TRM. As a result, the resistance value of resistive element R6 can be adjusted in accordance with trimming code TRM.

Referring to FIG. 10 again, reference voltage circuit 11A adds, at an appropriate ratio, base-to-emitter voltage Vbe1 of diode D1 having a negative temperature dependence and base-to-emitter voltage difference ΔVbe between diodes D1 and D2 having a positive temperature dependence as shown by the equation (7) above, and thereby, generates reference voltage VBGR with low temperature dependence. This addition ratio corresponds to a ratio R7/R4 between the resistance value of resistive element R7 and the resistance value of resistive element R4.

However, when fluctuations occur in the process of manufacturing the semiconductor device, the temperature dependencies of actual Vbe1 and ΔVbe may deviate from the design values. In reference voltage generating circuit 1A according to the second embodiment, the resistance values of resistive elements R6 and R7 are finely adjusted by trimming code TRM, and thereby, such deviation caused by the process fluctuations can be compensated.

A trimming method in reference voltage circuit 11A according to the second embodiment will be described below. FIGS. 12A to 12E show the temperature characteristic of output voltage VREF of reference voltage circuit 11A. In each of FIGS. 12A to 12E, the vertical axis indicates output voltage VREF and the horizontal axis indicates temperature T.

Figures 12A, 12B, 12C, 12D, 12E:
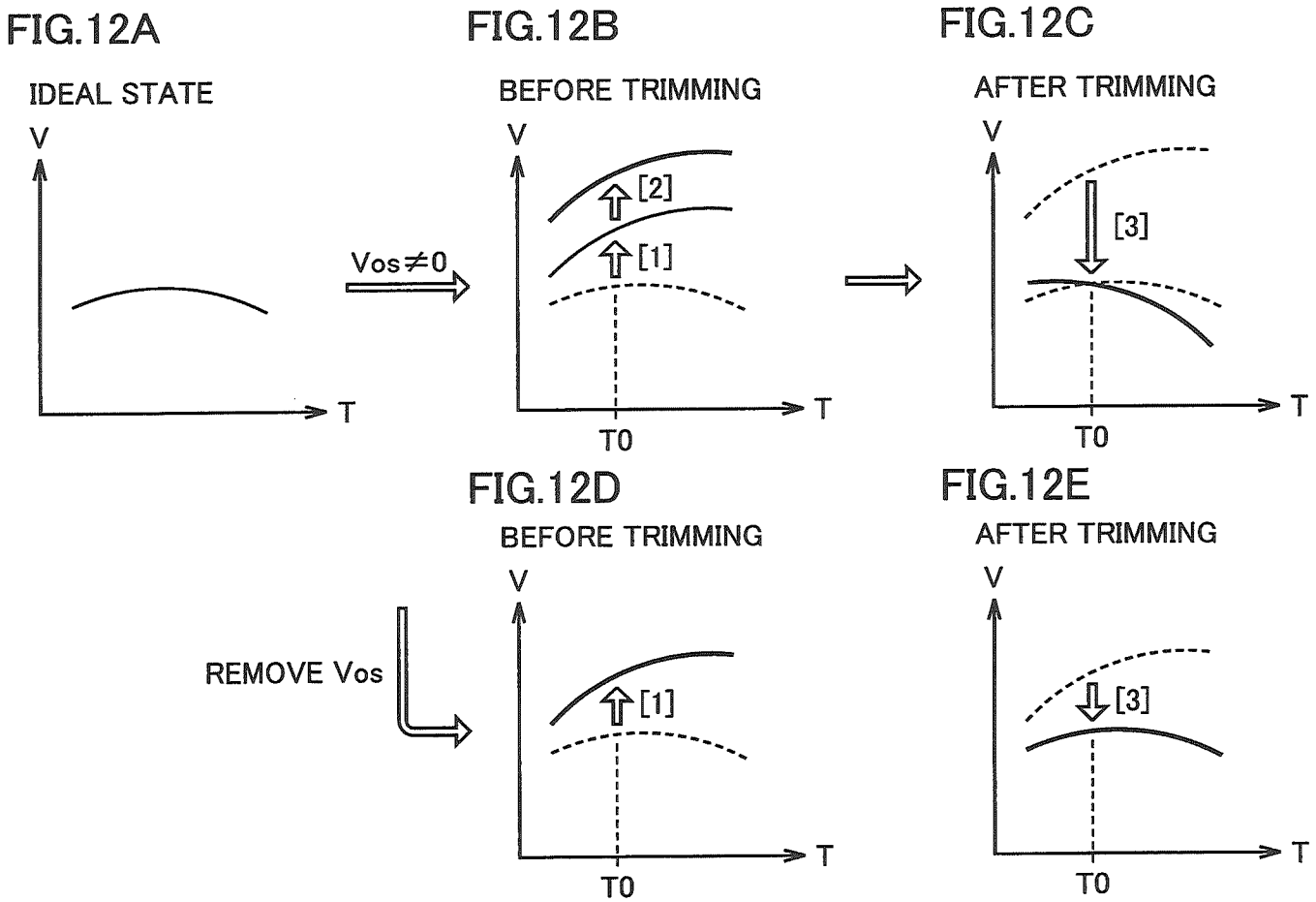
FIGS. 12A to 12E are diagrams for describing a trimming method in a reference voltage circuit according to the second embodiment.

FIG. 12A shows offset voltage Vos of operational amplifier AMP1 and the temperature characteristic of output voltage VREF in the state where there are no process fluctuations (ideal state). Output voltage VREF hardly changes with temperature change and a fluctuation range is kept at several millivolts.

In contrast to this, FIG. 12B shows offset voltage Vos of operational amplifier AMP1 and the temperature characteristic of output voltage VREF in the state where there are process fluctuations. In FIG. 12B, the broken line indicates output voltage VREF in the ideal state. When the process fluctuations occur, the characteristic values of the resistive elements, the MOS transistors and the like fluctuate, and thus, a primary temperature coefficient fluctuates in the reference voltage generating circuit. As a result, the temperature characteristic of output voltage VREF changes in the direction shown by an arrow [1], by way of example, and takes the characteristic shown by the thin solid line. The fluctuation range of output voltage VREF with respect to temperature change becomes larger.

Furthermore, a zero-order temperature coefficient changes due to an influence of offset voltage Vos of operational amplifier AMP1. Then, output voltage VREF shifts by an amount of voltage corresponding to offset voltage Vos, as shown by an arrow [2]. As a result, the temperature characteristic of output voltage VREF takes the characteristic shown by the thick solid line and deviates significantly from the temperature characteristic in the ideal state.

In order to compensate for this deviation of the temperature characteristic, the temperature characteristic is trimmed by using resistive elements R6 and R7 in the reference voltage generating circuit. Specifically, output voltage VREF at a prescribed temperature T0 is monitored and the resistance values of resistive elements R6 and R7 are adjusted such that monitored output voltage VREF matches an ideal value of output voltage VREF at temperature T0. By changing the resistance values of resistive elements R6 and R7, only the primary temperature coefficient of the temperature characteristic changes. As a result, output voltage VREF is brought closer to the ideal state while changing an inclination of the temperature characteristic, as shown by an arrow [3] in FIG. 12C.

The aforementioned trimming is, however, performed only for output voltage VREF at particular temperature T0, and thus, the unnecessary primary temperature coefficient remains in the temperature characteristic after trimming. As a result, the temperature characteristic after trimming may differ greatly from the ideal state as shown in FIG. 12C.

In contrast to this, in the reference voltage generating circuit according to the present embodiment, the offset voltage component is removed from output voltage VREF by the chopper operation in BGR circuit 10 and smoothing by LPF circuit 20. Therefore, as shown by the solid line in FIG. 12D, only fluctuations of the primary temperature coefficient caused by the process fluctuations appear in the temperature characteristic of output voltage VREF. Thus, as described above, by adjusting the resistance values of resistive elements R6 and R7 based on output voltage VREF at particular temperature T0, the temperature characteristic can be easily brought closer to the ideal state (refer to FIG. 12E). As described above, in reference voltage generating circuit 1A according to the second embodiment, the accuracy of BGR circuit 10A is further enhanced, and thus, the reference voltage that is not dependent on temperature and process fluctuations can be generated in a stable manner.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A reference voltage generating circuit, comprising:

a bandgap reference circuit generating a bandgap reference voltage; and a filter circuit for smoothing said bandgap reference voltage, wherein said bandgap reference circuit includes:

a reference voltage circuit that is configured to include an operational amplifier receiving a first input voltage at one differential input terminal and receiving a second input voltage at the other differential input terminal, and that generates said bandgap reference voltage based on an output voltage of said operational amplifier; and a switch circuit for alternately switching between the differential input terminal receiving said first input voltage and the differential input terminal receiving said second input voltage, in synchronization with a clock signal, and said filter circuit operates in synchronization with said clock signal and calculates a moving average value of said bandgap reference voltage in a most recent one clock cycle, wherein said reference voltage circuit is configured to generate said bandgap reference voltage having a first voltage value when said clock signal is in a first logic level, and to generate said bandgap reference voltage having a second voltage value different from said first voltage value when said clock signal is in a second logic level, said filter circuit includes:

a first capacitive element charged with said bandgap reference voltage having said first voltage value in a first clock cycle;

a second capacitive element charged with said bandgap reference voltage having said second voltage value in said first clock cycle;

a third capacitive element charged with said bandgap reference voltage having said first voltage value in a second clock cycle immediately before or after said first clock cycle; and a fourth capacitive element charged with said bandgap reference voltage having said second voltage value in said second clock cycle, and in said second clock cycle, said filter circuit outputs said bandgap reference voltage having a magnitude corresponding to an average value of charging voltages of said first and second capacitive elements, and in said first clock cycle, said filter circuit outputs said bandgap reference voltage having a magnitude corresponding to an average value of charging voltages of said third and fourth capacitive elements.

2. The reference voltage generating circuit according to claim 1, wherein said filter circuit further includes:

first to fourth switches connected between an input terminal and said first to fourth capacitive elements, respectively; and fifth to eighth switches connected between an output terminal and said first to fourth capacitive elements, respectively, and the reference voltage generating circuit further comprises a control signal generating circuit generating a control signal for controlling ON/OFF of said first to eighth switches by using said clock signal.

3. The reference voltage generating circuit according to claim 1, wherein said reference voltage circuit further includes:

a first resistive element connected between an output terminal and the input terminal of said first input voltage, and having an adjustable resistance value; and a second resistive element connected between said output terminal and the input terminal of said second input voltage, and having an adjustable resistance value.

* * * * *